United States Patent [19]

Staal et al.

[11] 4,039,989

[45] Aug. 2, 1977

[54] DEFLECTION SYSTEM FOR A COLOR TELEVISION DISPLAY TUBE

[75] Inventors: Franciscus Cornelis Maria Antonius Staal; Nicolaas Gerrit Vink, both of Eindhoven, Netherlands

[73] Assignee: U.S. Philips Corporation, New York, N.Y.

[21] Appl. No.: 758,478

[22] Filed: Jan. 11, 1977

[30] Foreign Application Priority Data

Jan. 23, 1976 Netherlands ..... 7600687

[51] Int. Cl.[2] ..... H01F 5/00

[52] U.S. Cl. ..... 335/213; 335/210

[58] Field of Search ..... 335/210, 212; 313/440

[56] References Cited

U.S. PATENT DOCUMENTS

| | | | |
|---|---|---|---|
| 3,622,927 | 11/1971 | Wlashburn | 335/213 |
| 3,731,241 | 5/1973 | Coupland | 335/213 |
| 3,735,193 | 5/1973 | Ikeuchi | 335/213 X |

*Primary Examiner*—George Harris

*Attorney, Agent, or Firm*—Frank R. Trifari; Henry I. Steckler

[57] ABSTRACT

A deflection system for a color television display tube having saddle-shaped line deflection coils. For the correction of remaining convergence errors in the corners of the display screen a bend is provided in the boundary between the active parts of each of the line deflection coils and the coil window, so that the window is locally widened.

2 Claims, 2 Drawing Figures

DEFLECTION SYSTEM FOR A COLOR TELEVISION DISPLAY TUBE

The invention relates to a deflection system for a colour television display tube of the shadow mask type having a rear, cylindrical part in which a device is accommodated for generating three electron beams extending in a common horizontal plane, and a front flaring part, which deflection system can be arranged coaxially around the tube near the transition between the two parts and comprises for the deflection of the electron beams in the horizontal direction two diametrically arranged saddle-shaped line deflection coils each of which comprises two active parts which are situated on either side of a window.

From the publication "Philips Product Information No.58" (see in particular pages 6 and 7) it is known that such a deflection system can in principle be constructed so that the three electron beams converge without separate auxiliary means. For that purpose the deflection coils should show a certain extent of astigmatism. It has been found in practice that in some cases certain errors remaining in the convergence still occur in the corners of the display screen. These errors could be avoided by making the whole line deflection field to be more strongly astigmatic, but this would endanger the good convergence in other positions of the display screen. It is therefore desirable to increase the astigmatism only locally in the line deflection field so that only the electrons which are deflected towards the corners of the display screen are influenced by it.

It is the object of the invention to provide a defection system which can generate a line deflection field having such desired properties and for that purpose the invention is characterized in that the boundary between each of the two active parts and the window shows at least one bend in such manner that the window is widened at the area of the bends.

The bend is preferably present apporximately halfway the boundary between the active part and the window, that is at a distance of at least $\frac{1}{3}$L of each of the ends of said boundary, L being the length of the boundary line.

Figure 1:
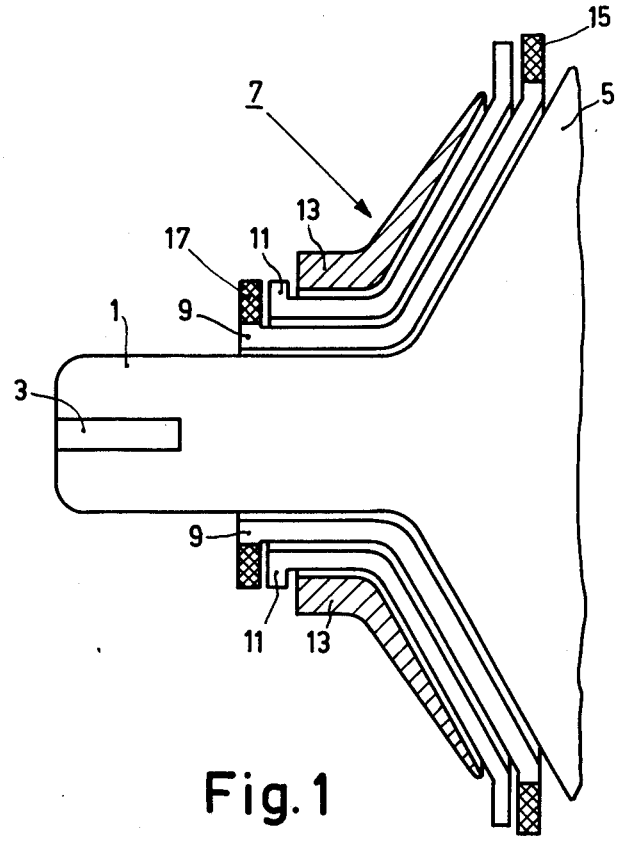
Figure 2:
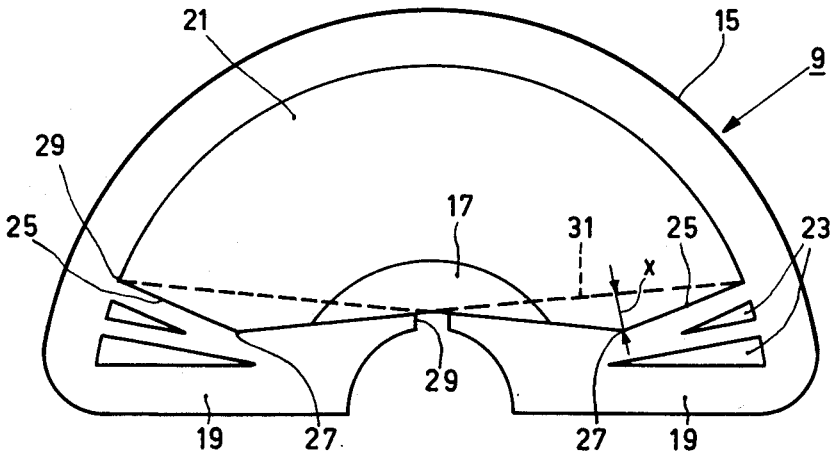

The invention will be described in greater detail with reference to the drawing, in which FIG. 1 is a diagrammatic longitudinal sectional view of a part of a colour television display tube having a deflection system according to the invention, and FIG. 2 is a front elevation of a line deflection coil of the deflection system shown in FIG. 1.

The colour display tube shown in FIG. 1 comprises a rear, cylindrical part 1 in which three juxtaposed electron guns 3 are accommodated, and a front, flaring part 5 in which a colour selection electrode (shadow mask) and a display screen are present (not shown). Arranged coaxially with the axis of the tube is a deflection system 7 which is present at the area of the transition between the rear part 1 and the front part 5 of the tube. The deflection system 7 comprises a set of saddle-like line deflection coils 9 for the deflection in the horizontal direction of the electron beams generated by the electron guns 3, a set of saddle-shaped picture deflection coils 11 for the deflection in the vertical direction, and a ferromagnetic angular core 13 surrounding the two sets of coils.

FIG. 2 is a front elevation of the upper line deflection coil. It comprises a front coil head 15 and a rear coil head 17 as well as two active parts 19. The active parts 19 may have apertures 23.

In order to make the magnetic field generated by the line deflection coils locally more strongly astigmatic so that remaining convergence errors in the corners of the display screen are avoided, the boundary 25 between each of the active parts 19 and the window 21 shows a bend 27. Said bend is directed outwards so that the window 21 is widened at the area of the bends.

It has been found that the best result is obtained when the bend 27 is present approximately halfway the boundary 25. This means that the distance between the bend 27 and each of the ends 29 of the boundary 25 may not be more than one third of the distance between the said two ends.

The extent to which the boundary 25 is bent depends naturally on the desired correction. For a display tube having a diagonal of the display screen of 56 cm the distance $x$ in a given case between the bend 27 and a straight line 31 joining the two ends 29 of the boundary 25 proved to have to be approximately 10 mm.

If desired the correction can still be improved by providing more than one bend 27 in each boundary 25.

What is claimed is:

1. A deflection system for a colour television display tube of the shadow mask type having a rear cylindrical part in which a device is accommodated for generating three electron beams extending in a common horizontal plane, and a front flaring part, which deflection system can be arranged coaxially around the tube near the transition between the two parts, said deflection system comprising two diametrically arranged saddleshaped line deflection coil means for deflection of the electron beams in the horizontal direction, each coil comprising two active parts situated on either side of a window, the boundary between each of the active parts and the window having at least one bend in such manner that the window is widened at the area of the bends.

2. A deflection system as claimed in claim 1, wherein the bend is present approximately halfway between the boundary between the active part and the window.

* * * * *